US009301582B2

(12) United States Patent
Haythornthwaite et al.

(10) Patent No.: US 9,301,582 B2
(45) Date of Patent: Apr. 5, 2016

(54) UMBRELLA HAVING IMPROVED SHAFT AND RIB ASSEMBLY

(71) Applicant: Shedrain Corporation, Portland, OR (US)

(72) Inventors: David Ryan Haythornthwaite, Fujian Province (CN); Andrew Paul Haythornthwaite, Fujian Province (CN)

(73) Assignee: SHEDRAIN CORPORATION, Portland, OR (US)

( * ) Notice: Subject to any disclaimer, the term of this patent is extended or adjusted under 35 U.S.C. 154(b) by 27 days.

(21) Appl. No.: 14/049,703

(22) Filed: Oct. 9, 2013

(65) Prior Publication Data

US 2015/0096601 A1 Apr. 9, 2015

(51) Int. Cl.

| | |
|---|---|
| ***A45B 25/22*** | (2006.01) |
| ***A45B 19/10*** | (2006.01) |
| ***A45B 19/04*** | (2006.01) |
| ***A45B 25/02*** | (2006.01) |
| ***A45B 25/14*** | (2006.01) |
| *A45B 9/00* | (2006.01) |

(52) U.S. Cl.

CPC ..... *A45B 25/22* (2013.01); *A45B 19/04* (2013.01); *A45B 19/10* (2013.01); *A45B 25/02* (2013.01); *A45B 25/143* (2013.01); *A45B 2009/007* (2013.01)

(58) Field of Classification Search

CPC ..... A45B 25/02; A45B 25/22; A45B 19/04; A45B 2009/005; A45B 2009/007; A45B 25/16; A45B 19/00; A45B 19/10; A45B 25/143

USPC ..... 135/22–23, 25.1, 25.3, 25.32, 27, 135/31–32, 33.5, 4

See application file for complete search history.

(56) References Cited

U.S. PATENT DOCUMENTS

| | | | | | |
|---|---|---|---|---|---|
| 559,577 | A | * | 5/1896 | Hadfield | 135/27 |
| 1,104,598 | A | * | 7/1914 | Wyskosky | 135/23 |
| 1,444,017 | A | * | 2/1923 | Waschek | 244/142 |
| 2,616,439 | A | * | 11/1952 | Thompson | 135/25.31 |
| 2,833,297 | A | * | 5/1958 | Tibony | 135/25.31 |
| 4,456,023 | A | * | 6/1984 | Fujihashi | 135/25.41 |
| 6,058,952 | A | * | 5/2000 | Lin et al. | 135/29 |
| 6,186,157 | B1 | * | 2/2001 | Lin et al. | 135/27 |
| 6,338,353 | B1 | * | 1/2002 | Chen | 135/20.3 |

(Continued)

FOREIGN PATENT DOCUMENTS

| | | | |
|---|---|---|---|
| FR | 2844430 | A * | 3/2004 |
| GB | 2120547 | A * | 12/1983 |
| JP | 2002336018 | A * | 11/2002 |

*Primary Examiner* — Winnie Yip

(74) *Attorney, Agent, or Firm* — Leason Ellis LLP

(57) ABSTRACT

An umbrella is formed of an elongated shaft having a first end and an opposite second end and a runner slidably disposed about the elongated shaft. The umbrella includes a rib assembly including a plurality of ribs that are attached to the runner by a plurality of struts that move between open and closed positions. In accordance with the present invention, the elongated shaft has a cross-sectional shape defined by a plurality of curved sections and a plurality of planar sections interspersed between the plurality of curved sections for providing increased torsional strength to the elongated shaft. At least one of the ribs can have a cross-sectional shape defined by a plurality of curved sections and a plurality of planar sections interspersed between the plurality of curved sections for providing increased torsional strength to the at least one rib.

12 Claims, 10 Drawing Sheets

(56) References Cited

U.S. PATENT DOCUMENTS

| | | | | |
|---|---|---|---|---|
| 6,360,759 | B1 | 3/2002 | Lin et al. | |
| 6,497,242 | B1 * | 12/2002 | Lin et al. | 135/31 |
| 6,588,439 | B2 * | 7/2003 | Wu | 135/27 |
| 6,948,506 | B2 * | 9/2005 | Wang | 135/28 |
| 7,415,986 | B2 * | 8/2008 | Wu | 135/33.7 |
| 7,588,042 | B2 * | 9/2009 | Chang | 135/25.1 |
| 2004/0149326 | A1 | 8/2004 | Hsieh | |
| 2008/0149153 | A1 * | 6/2008 | Chang | 135/25.1 |
| 2013/0228203 | A1 | 9/2013 | David | |

* cited by examiner

UMBRELLA HAVING IMPROVED SHAFT AND RIB ASSEMBLY

TECHNICAL FIELD

The present invention relates to umbrellas and more particularly, relates to an umbrella shaft and rib assembly having increased torsional strength.

BACKGROUND

As is well known, an umbrella is a device that protects the user from the elements and in particular from liquid and frozen precipitation or even the sun, etc. A traditional umbrella has the following parts: a pole, a canopy, ribs, a runner, springs and a ferrule. A pole is the metal or wooden shaft that runs between the umbrella's handle at the bottom (or the base stand in the case of a patio model) and the canopy at the top. The canopy is the fabric part of the umbrella that catches the rain, the wind and the sun. The ribs are what give an umbrella its structure and shape. Outer ribs hold up the canopy and inner ribs (sometimes called stretchers) act as supports and connect the outer ribs to the umbrella pole. A runner slides up and down the pole while connected to the ribs/stretchers, and is responsible for the opening and closing of the canopy. Many umbrella designs include a top spring to hold the runner up when the canopy is open, a bottom spring to hold the runner down when the canopy is closed, and sometimes a center ball spring to extend the pole length in telescopic models. Strictly ornamental, the finial (also called the ferrule) is found on the very top of the umbrella, above the canopy.

Umbrella ribs function in a folding construction supporting the umbrella canopy fabric. Under normal operating conditions, the forces acting on the umbrella canopy fabric increase toward peak values when the canopy becomes fully deployed and when wind gusts tend to overturn the canopy. These forces are transmitted from the canopy to the canopy ribs, and can act on the ribs in opposite directions depending on the direction of the wind. The ribs thus have to be strong enough to withstand forces which can act on them from anyone of the two main opposite directions.

In addition to their strength requirements, the shape of the umbrella ribs should change between a substantially straight contour when the umbrella is folded and a curved one, when the canopy if fully deployed. The straight design is aimed to allow the folded fibs to lay parallel to the shaft of the umbrella when the umbrella is folded and the curved design provides for the typical mushroom-like shape (also called bell shaped).

SUMMARY

According to one exemplary embodiment of the present invention, an umbrella is formed of an elongated shaft having a first end and an opposite second end and a runner slidably disposed about the elongated shaft. The umbrella includes a rib assembly including a plurality of ribs that are attached to the runner by a plurality of struts that move between open and closed positions in which in the open position, the ribs are in an open, extended position and in the closed position, the ribs are in a closed, collapsed position, the struts extending between at least one rib and the runner. In accordance with the present invention, the elongated shaft has a cross-sectional shape defined by a plurality of curved sections and a plurality of planar sections interspersed between the plurality of curved sections for providing increased torsional strength to the elongated shaft.

In one embodiment, there are three curved sections and three planar sections interspersed between the three curved sections. Each of the three curved sections has a convex shape. The planar sections can be disposed about 120 degrees apart from one another.

In addition, each set of interconnected ribs is formed of at least one rib formed of a first material and at least one rib formed of a second material that is different than the first material. The first material can be aluminum alloy and the second material can be a carbon material. In accordance with one embodiment, at least one rib of the one set of interconnected ribs has a cross-sectional shape defined by a plurality of curved sections and a plurality of planar sections interspersed between the plurality of curved sections for providing increased torsional strength to the at least one rib. There are three curved sections and three planar sections interspersed between the three curved sections, with the three curved sections each having a convex shape.

BRIEF DESCRIPTION OF THE DRAWING FIGURES

DETAILED DESCRIPTION OF CERTAIN EMBODIMENTS

As discussed herein, the present invention is directed to improvement with respect to a number of components of an umbrella including but not limited to a shaft construction and a rib assembly thereof. As discussed herein, the features of the present invention can be implemented with both a manual type umbrella and an automatic type umbrella. In addition, the other features can be implemented with other types of umbrellas. Accordingly, the following discussion and figures describe exemplary embodiments that implement the teachings of the present invention.

Figure 1:
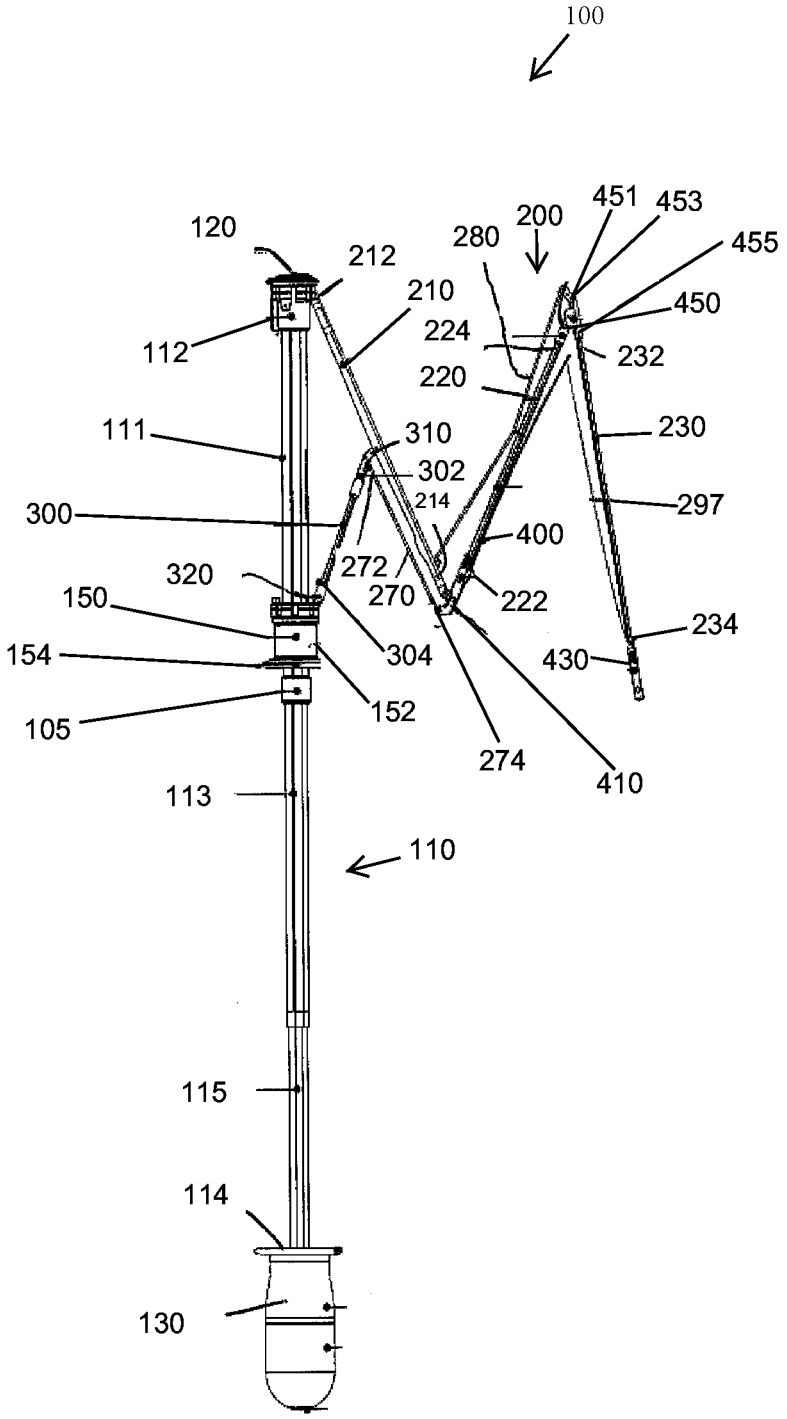
FIG. 1 is a side elevation view of an umbrella, of a manual type, including a shaft and an umbrella rib assembly in accordance with the present invention.

FIG. 1 shows a side view of an umbrella 100 in accordance with one exemplary embodiment of the present invention with only one rib assembly 200 being shown for sake of clarity and to simplify a discussion of the present invention. The umbrella 100 includes a shaft 110 that has a first (top) end 112 and an opposite second (bottom) end 114. The shaft 110 itself can be formed of any number of different components to cooperate to provide shaft 110 and the shaft 110 illustrated in FIG. 1 is part of a manual umbrella assembly in which the user manually opens and closes the umbrella as described herein. At the first end 112, a cap 120 is provided to close off the shaft 110 and at the second end 114, a handle 130 is provided for grasping by the user.

Referring to FIGS. 1-13, the illustrated shaft 110 is formed of three distinct shaft sections, namely, a first shaft section 111, a second shaft section 113, and a third shaft section 115. The first shaft section 111 is attached at one end to the cap 120 and at its other end to one end of the second shaft section 113. The second shaft section 113 is attached at its other end to one end of the third shaft section 115. The third shaft section 115 is attached at its other end to the handle 130. Thus, the first shaft section 111 represents the top shaft section; the second shaft section 113 represents the middle shaft section; and the third shaft section 115 represents the bottom shaft section. The dimensions of the individual shaft sections 111, 113, 115 can differ and in particular, at least one of the length and width (e.g., diameter) can be different. In the illustrated embodiment, the first shaft section 111 has the greatest width relative to the two other sections 113, 115 and the third shaft section 115 has the least width relative to two other sections 111, 113. For example, the first shaft section 111 can be a 14 mm shaft section; the second shaft section 113 can be a 12 mm shaft section; and the third shaft section 115 can be a 10 mm shaft section. The manual shaft 110 can thus operate as a telescoping structure in which the shaft sections 111, 113 are extended along a central longitudinal axis of the umbrella shaft 110 when the umbrella 100 is opened.

Between the shaft sections 111, 113, a coupling member 105 can be provided and in particular, the coupling member 105 can be a shaft ring (e.g., a 14 mm shaft ring).

As mentioned above, one of the main components of an umbrella is a runner 150. The runner 150 is the part of the umbrella that opens and closes the umbrella 100, with the runner 150 moving along the shaft 110. The runner 150 is located between the coupling member 105 and the cap 120 and surrounds the shaft 110. In the illustrated embodiment, the runner 150 is formed of several parts or portions including a cylindrical shaped base portion 152 and a runner ring 154.

Figure 3:
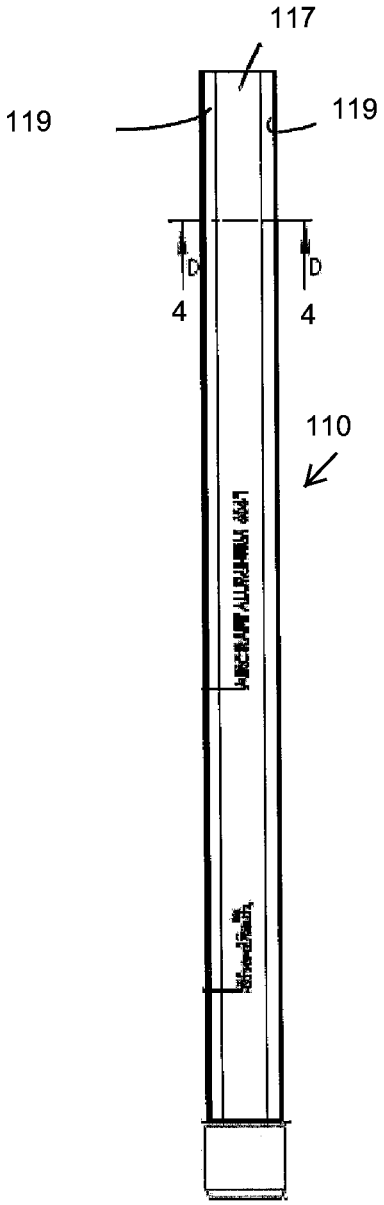
FIG. 3 is an enlarged side elevation view of a portion of the shaft of FIG. 1.
Figure 4:
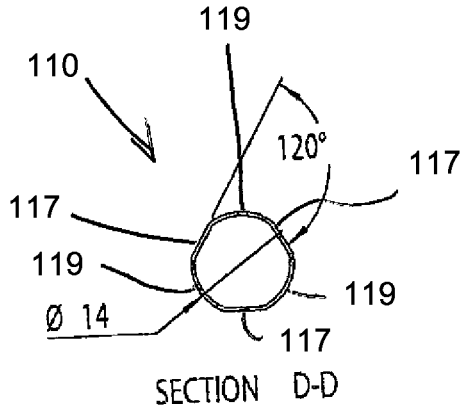
FIG. 4 is a cross-sectional view taken along the line 4-4 of FIG. 3.

In accordance with one aspect of the present invention, the shaft 110 has a customized shape that is designed to provide increased torsional strength. FIG. 3 is a side view of a section of the shaft 110 and FIG. 4 shows a cross-sectional view of the shaft 110. In particular, the shaft 110 has a faceted design in that it includes faces (flats/planar sections) 117 formed circumferentially thereabout but still has curvature 119 in select regions, such as between the faces 117. In the illustrated embodiment, there are three faces 117 formed about 120 degrees apart from one another. It will be appreciated that each of the shaft sections 111, 113, 115 has this construction, with only the width varying between the sections 111, 113, 115.

As will be appreciated by the following description, the rib assembly 200 is coupled to both the cap 120 and the runner 150 and this results in the opening and closing of the rib assembly 200 and the attached canopy (not shown) based on the direction of movement of the runner 150. The connection between the rib assembly 200 and the runner 150 is made by a strut 300. The strut 300 is an elongated structure that has a first end 302 and an opposite second end 304, with the first end 302 being pivotally attached to the rib assembly 200 and the second end 304 being pivotally attached to the runner 150. The pivotal connection between the strut 300 and the runner 150 and between the strut 300 and the rib assembly 200 can be accomplished with a fastener, such as a rivet or pin, etc. More specifically, a first strut joint 310 is formed between the strut 300 and the rib assembly 200 at first end 302 and a second strut joint 320 is formed between the strut 300 and the runner 150 at the second end 304.

The strut 300 can be formed of any number of different materials including a metal (e.g., a zinc alloy).

As shown in FIGS. 1-13, the rib assembly 200 is formed of a number of components that are coupled to one another and to other components of the umbrella to provide a rib assembly that opens and closes. In the illustrated embodiment, the rib assembly 200 includes a plurality of ribs and more particularly, the rib assembly 200 includes three distinct ribs, namely, a first rib 210, a second rib 220, and a third rib 230. The first rib 210 includes a first end 212 and an opposing second end 214; the second rib 220 includes a first end 222 and an opposing second end 224; and the third rib 230 includes a first end 232 and an opposing second end 234.

The attachments between the ribs 210, 220, 230 are of a pivotal nature to allow the rib assembly 200 to both open and close. More specifically and as described herein, a pivotal joint or the like can be provided between the respective parts to allow the desired rib action when the rib assembly 200 both opens (expands) and closes (collapses).

Figures 7, 7A, 7B:
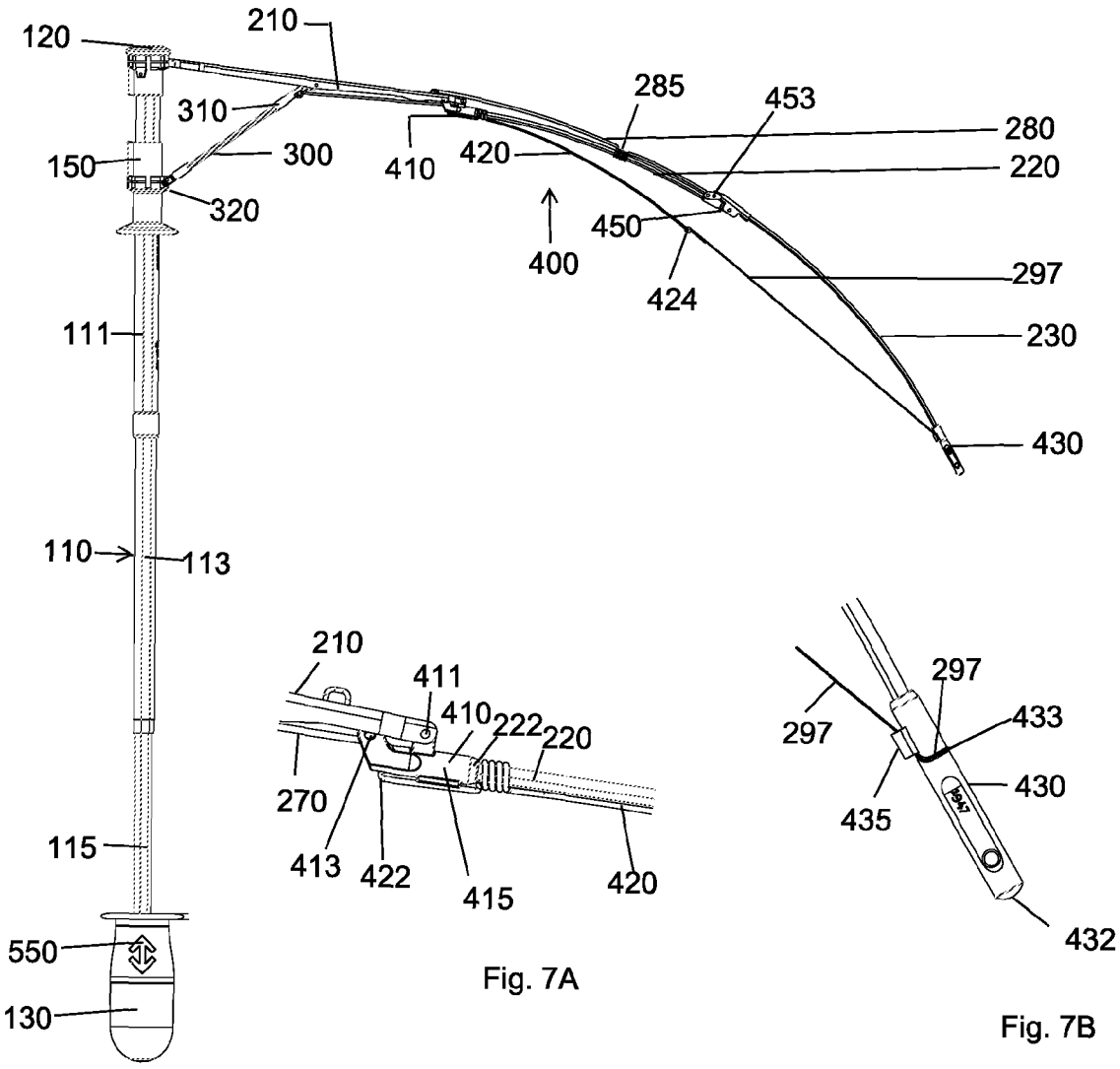
FIG. 7 is a side elevation view of an umbrella, of an automatic type, showing an anti-inversion mechanism in an open position.
FIG. 7A is a close-up of an anti-inversion joint of the mechanism of FIG. 8 in an open position and under tension.
FIG. 7B is a close-up of an anti-inversion tip of the mechanism of FIG. 8 in an open position and under tension.

The first end 212 of the first rib 210 is pivotally connected to the top cap 120 and the second end 214 is connected to a first rib joint 410 which, as discussed below, is in the form of an anti-inversion rib joint. The first rib joint 410 is configured to allow the first rib 210 and second rib 220 to pivot between a fully closed position and a fully opened position (FIG. 7). The first rib joint 410 includes a number of attachment points and in particular, the first rib joint includes a first attachment point 411 to which the second end 214 of the first rib 210 is attached. The first rib joint 410 also includes a second attachment point 413 which is attached to another part as described below and includes a third attachment point 415 which is attached to a first end 222 of the second rib 220. The construction of the first rib joint 410 is of the type such that the attachment points 411, 413, 415 are of a pivoting nature in that each of the elements that are attached to the first rib joint 410 pivot relative thereto.

The second end 224 of the second rib 220 is connected to the first end 232 of the third rib 230. In particular, a second rib joint 450 is provided between the second rib 220 and the third rib 230. The second rib joint 450 is configured to allow the second rib 220 and third rib 230 to pivot between a fully closed position and a fully opened position (FIG. 7). The second rib joint 450 includes a number of attachment points and in particular, the second rib joint 450 includes a first attachment point 451 to which the second end 224 of the second rib 220 is attached. The second rib joint 450 also includes a second attachment point 453 which is attached to another part as described below. The construction of the second rib joint 450 is of the type such that the attachment points 451, 453 are of a pivoting nature in that each of the elements that are attached to the second rib joint 450 pivot relative thereto.

Figure 2:
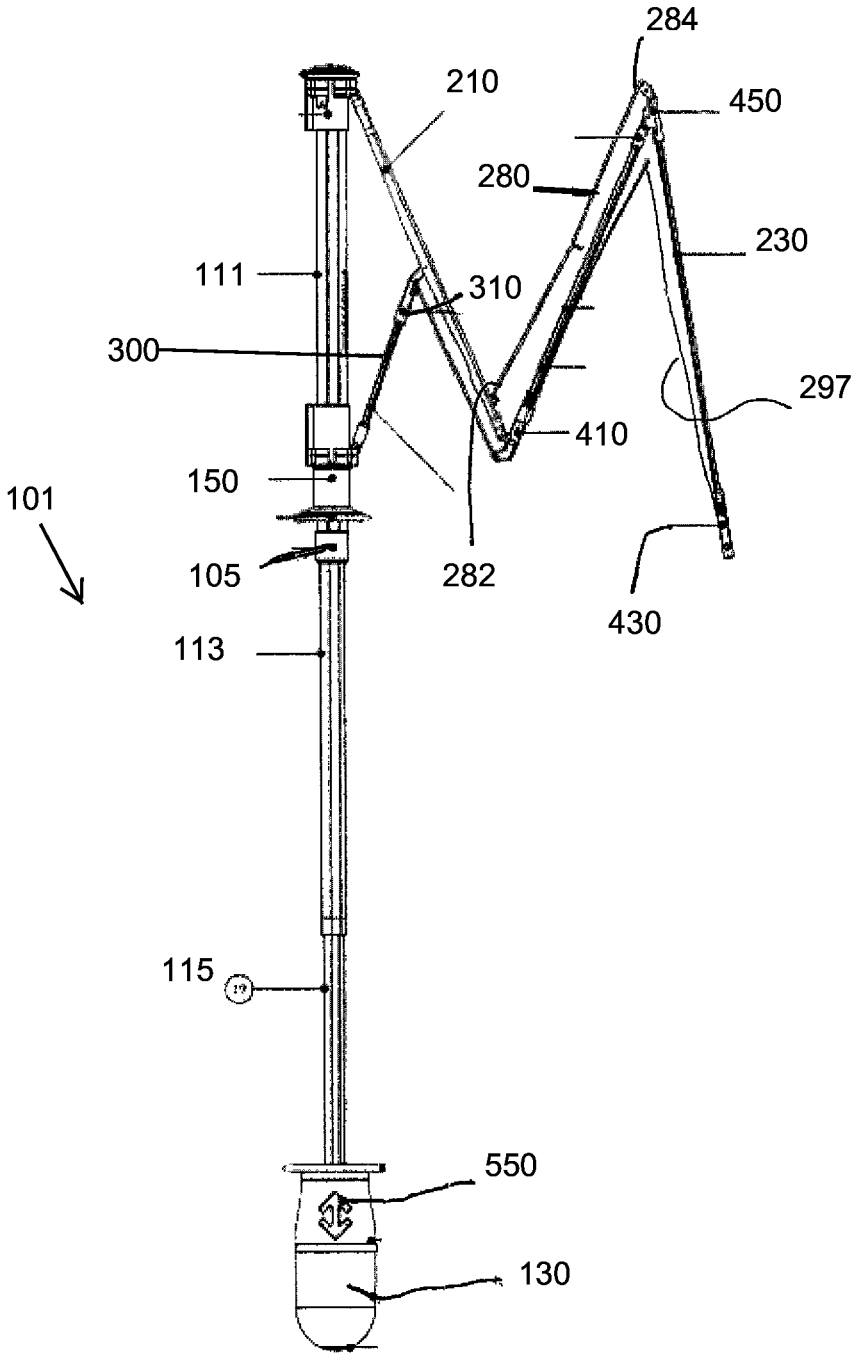
FIG. 2 is a side elevation view of an umbrella, of an automatic type, including a shaft and an umbrella rib assembly in accordance with the present invention.
Figure 8:
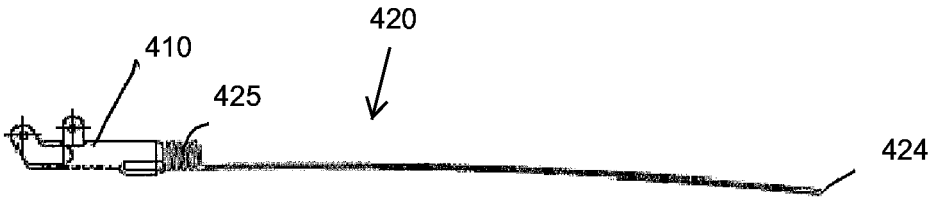
FIG. 8 is a side elevation view of a spring wire element that is part of an anti-inversion mechanism that is part of the umbrella of FIG. 1.

The strut 300 is pivotally connected to the first rib 210. As shown in FIGS. 1 and 2, the strut 300 is attached to the first rib 210 at an intermediate location thereof and is designed such that as the strut 300 is moved upwardly due to the action of the runner 150, the rib assembly 200 opens.

The rib assembly 200 also has a number of reinforcing elements. More specifically, the rib assembly 200 can include a first reinforcing element 270 that at a first end 272 is connected to the end 302 of the strut 300 (at a pivot joint) and at a second end 274 is connected to the pivot joint 410 at connection point 413. As shown, the connection between the first reinforcing element 270 and the second rib 220 is near the first end 222, while the connection between the first rib 210 and the second rib 220 is at a location that is slightly spaced from the first end 222. The connection between the first reinforcing element 270 and the strut 300 and the second rib 220 is of a pivotal nature based on the construction of the pivot joint 410.

In one example, the reinforcing element 270 is in the form of elongated structures, such as an elongated rod, wire, cable, spring element, etc. The reinforcing element 270 serves to provide reinforcement and also serve to control the forces generated by operation of the rib assembly.

According to one aspect of the present invention, an anti-inversion mechanism 400 is provided and is configured to counter an inversion force that is applied to the umbrella during select operating conditions and in particular, during windy conditions or other adverse conditions. As is well known by users of umbrellas, if a sudden gust of wind is directed upwardly toward the inside of the umbrella, the pressure applied by the wind will invert the canopy causing the ribs to work counterproductively forcing it outwards. The canopy generally assumes a concave shape when inversion occurs and similarly, the ribs are force to pivot in unintended directions which can result in one or more ribs breaking. This renders the umbrella not usable. The umbrella of the present invention has the anti-inversion mechanism 400 that is made up of several components that are individually discussed below.

FIG. 7 shows the anti-inversion mechanism 400 in an open (normal) position in which one or more of the components are under tension. More specifically, the anti-inversion mechanism 400 includes an anti-inversion rib joint 410 and an anti-inversion spring 420.

The anti-inversion rib joint 410 is actually the joint between the first and second ribs 210, 220 and permits the opening and closing between the first and second ribs 210, 220 as will be appreciated in view of FIG. 2 in which the ribs 210, 220 are partially opened and FIG. 7 in which the ribs 210, 220 are fully opened and the runner 150 is in the locked position. The anti-inversion rib joint 410 also provides the structure to which one end of the anti-inversion spring 420 in anchored and more particularly, a first end 422 of the anti-inversion spring 420 is coupled to the anti-inversion rib joint 410.

Figure 10:
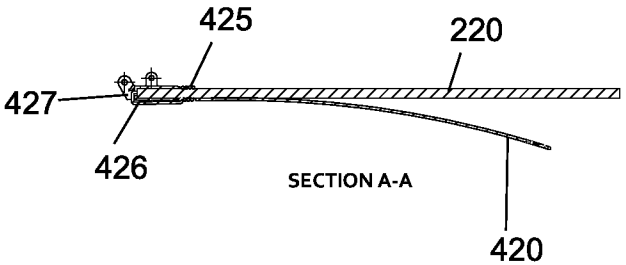
FIG. 10 is a cross-sectional view taken along the length of the mechanism and rib of FIG. 9.
Figure 11:
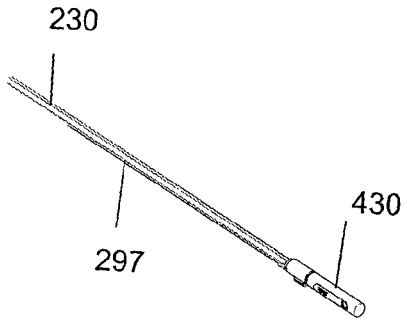
FIG. 11 is a perspective view of an anti-inversion tip showing the coupling between the anti-inversion wire and the tip.
Figure 13:
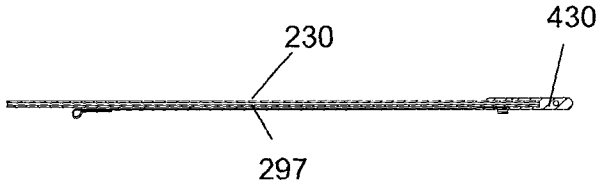
FIG. 13 is a cross-sectional view of the mating between the anti-inversion wire and tip of FIG. 11.

The anti-inversion spring 420 has an opposite second end 424 and is formed of a flexible material and has resiliency as a result of its functioning as a spring. Along the length of the anti-inversion spring 420, the anti-inversion spring 420 has a coiled section 425 proximate to the first end 422. As shown in FIG. 7A and FIGS. 10 and 11, the anti-inversion spring 420 is both coupled to the second rib 220 and to the anti-inversion rib joint 410. More specifically, the anti-inversion spring 420 runs substantially along the underside (bottom) of the second rib 220 with the exception of the coiled section 425 which is disposed about the second rib 220 adjacent one end (distal end) of the anti-inversion rib joint 410. The anti-inversion spring 420 thus wraps around the second rib 220 and connects into the back (proximal end) of the anti-inversion rib joint 410. More specifically, the anti-inversion spring 420 has a hook portion 426 at its first end 422 that is formed by a vertical end portion (end wall) 427 that is disposed along the proximal end of the anti-inversion joint 410 and a lip portion 427 that is disposed within an opening, slot, etc. that is formed in the proximal end of the anti-inversion joint 410.

The coiled section 425 is thus defined by a plurality of coils that have a central bore through which the second rib 220 extends. The remaining portion of the anti-inversion spring 420 can be in the form of an elongated wire having a free distal end which represents the second end 424. The length of the anti-inversion spring 420 is less than the length of the second rib 220.

The second end 424 of the anti-inversion spring 420 is not attached to the second rib 220 but rather is free therefrom. The second end 424 of the anti-inversion spring 420 is instead attached to a wire or cable 297 that is attached at its opposite end to an anti-inversion tip 430 at the second end 234 of the third rib 230. The cable 297 thus is spaced from but extends along a length of third rib 230. The wire/cable 297 can thus be thought of as being an anti-inversion wire that attaches the anti-inversion mechanism to the canopy tip 430 as disclosed herein. The cable 297 can be and preferable is in the form of a nylon coated stainless steel wire. However, other structures may also be suitable such as a Kevlar fiber or other types of high strength fibers.

Any number of different techniques can be used to attach one end of the wire 297 to the second end 424 of the anti-inversion spring 420. For example, the second end 424 of the anti-inversion spring 420 can include a hook or other structure 440 that allows the one end of the wire 297 to the anti-inversion spring 420. The hook 440 can has a coiled or curved construction with an opening to allow a loop at the one end of the wire 297 to be attached to the hook 440.

Figure 12:
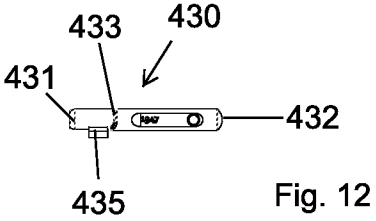
FIG. 12 is a side elevation view of the tip.
Figure 9:
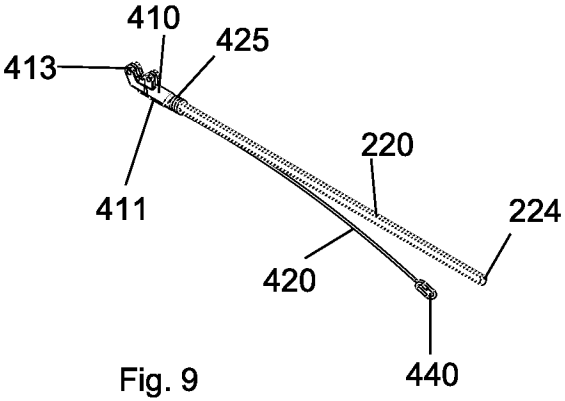
FIG. 9 is a side perspective view of the anti-inversion mechanism coupled to one rib.

As best shown in FIGS. 7B and 12, the other end of the wire 297 is attached to the anti-inversion tip 430. The anti-inversion tip 430 has a first end 431 and an opposite second end 432 that represents the closed distal end. The first end 431 is the end to which the second end 234 of the third rib 230 is attached by being inserted into an opening (slot) formed in the body of the tip 430.

In accordance with the present invention, the anti-inversion tip 430 has a recess or groove 433 formed therein and in particular, the groove 433 extends along the sides and the top of the body of the anti-inversion tip 430. The groove 433 is of a depth that permits the wire 297 to be received and contained therein. The groove 433 thus acts as a locating and coupling feature for positioning and attaching the wire 297 to the anti-inversion tip 430.

The anti-inversion tip 430 also includes a bottom wire connector 435 in the form of a small hollow tubular structure that is located proximate to the first end 431 of the tip 430 along the underside thereof. The connector 435 can be open at both ends with one open end being proximate the groove 433. The wire 297 is attached to the anti-inversion tip 430 by looping the wire 297 over the top of the tip 430, whereby the wire 297 is disposed (seated) within the groove 433 and then a free end of the wire 297 is fed through the connector 435. This results in the wire 297 being locked in place.

The anti-inversion mechanism also works in unison with another reinforcing element, namely, a second reinforcing element 280 that is attached between the first rib 210 and the third rib 230 and is also coupled to the second rib 220 as described below. The second reinforcing element 280 is an elongated structure that has a first end 282 and an opposing second end 284, with the first end 282 being attached to the first rib 210 proximate the second end 214 thereof. The second end 284 of the second reinforcing element 280 is attached to a second rib joint 450 at the second attachment point 453. As mentioned herein, the connection between the second reinforcing element 280 and the first rib 210 and third rib 230 is of a type that the ribs 210, 230 freely open and close as the umbrella is opened and closed.

In the illustrated embodiment, the second reinforcing element 280 is not a linear structure but rather is a coiled structure and more particularly, the element 280 includes an intermediate coiled section 285 between the ends 282, 284. The coiled section 285 can be in the form of a single winding (coil) around the second rib 220 at an intermediate location thereof between the ends 222, 224.

As with the reinforcing element 270, the reinforcing element 280 can be in the form of elongated structures, such as an elongated rod, wire, cable, spring element, etc.

More specifically, the reason that the ribs (stretcher members) are made of aluminum alloy is it light weight which can provide convenience in use and a suitable strength to support the operation of the umbrella. Such a design does not reveal any shortcoming in a normal environment. However, in an area where wind is strong, such a rib structure will be easily damaged or broken because the umbrella canopy might be reversed when it bears strong winds. The reversal wind force will easily cause one or more of the ribs to be damaged or broken by irreversible bending. It ends the service life of the umbrella. This is a major disadvantage of traditional aluminum alloy umbrellas.

The second reinforcing element 280 can be thought of as being an actuator spring which works in combination with the anti-inversion spring 420 to ensure proper operation of the umbrella.

The anti-inversion spring 420 is thus configured such that it applies a counteractive force to resist inversion of the umbrella as a result of a force (e.g., pressure) applied to the underside of the canopy. The anti-inversion spring 420 (along with wire 297) thus applies a biasing force to maintain the rib assembly 200 and in particular, the third rib 230, etc., in a normal operating position. This biasing force thus counteracts upward movement of the third rib 230 as a result on an applied inversion force (e.g., a sudden gust of wind directed upwardly). The strength of the wire 297 prevents the outer peripheral part of the canopy from inverting by lifting upward (which results in stress on the parts and likely breakage).

In addition, the second reinforcing element (actuator spring) 280 is designed to prevent collapse of the second rib 220 in the even that a force, such as an inversion force, is applied to the umbrella. The action of the anti-inversion spring 420 and the actuator spring 280 thus ensures that the umbrella maintains its intended form in adverse conditions.

The ribs 210, 220, 230 can be formed of any number of different materials and it will be understood that according to the present invention, the ribs 210, 220, 230 can be formed of two or more different materials. For example, the rib 210 can be formed of a first material and the ribs 220, 230 can be formed of a second material. The rib 210 can be formed of a metal, such as aluminum; however, in accordance with one aspect of the present invention, the ribs 220, 230 are formed of a carbon material (e.g., fluted carbon).

Figure 5:
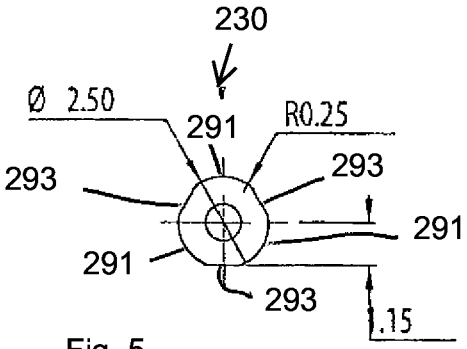
FIG. 5 is a cross-sectional view of one rib of the rib assembly of FIG. 1.
Figure 6:
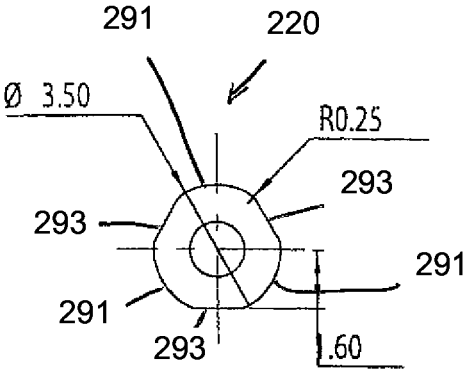
FIG. 6 is a cross-sectional view of another rib of the rib assembly of FIG. 1.

In addition, similar to the shaft 110 of the umbrella 100, one or more of the ribs 210, 220, 230 has a custom shape that is designed for torsional strength. In one embodiment, as mentioned above, the ribs 220, 230 can be formed of carbon material and can have the custom shape described herein. As shown in the cross-sectional view of FIGS. 5 and 6, the rib 220, 230 has a shape that is defined by a plurality of curved sections 291 interspersed with a plurality of planar sections 293 (flats). In particular, the cross-section of rib 230 is shown in FIG. 4, while the cross-section of rib 220 is shown in FIG. 5. In the illustrated embodiment, there are three curved sections 291 and three flats 293, with the curved sections 291 alternating with the flats 293 to form the shape of the rib. This rib shape provides increased torsional strength.

While each part of the umbrella is necessary for its operation, the runner 150 is the part that opens and closes it. When the runner 150 is all the way down, the struts 300 are folded flat against the shaft and the umbrella is "closed," with the waterproof material and the ribs wrapped around the shaft. To open the umbrella, the user slides the runner 150 all the way to the top. The struts 300 extend, raising the ribs to which they are attached and spreading the material tight (canopy) over the ribs.

As discussed herein, both the shaft 110 and one or more of the ribs 220, 230 are custom designed to provide increased torsional strength by having a faceted design. As discussed herein, torsional strength is the ultimate strength of a material subjected to torsional loading and is the maximum torsional stress that a material sustains before rupture. In other words, torsional strength is the resistance of a material to twisting (torque) and is related to shear strength.

FIGS. 2 and 7 show an umbrella 101 that is very similar to the umbrella 100 in that it includes the shaft 110 and the rib assembly 200. The umbrella 101 is of an automatic type (in contrast to the manual type shown in FIG. 1) and thus, the handle 130 is automated and includes an actuator, such as a push button 550. The illustrated push button is designed as a dual actuator in that pressing the button 550 once causes the umbrella to open and assume the position shown in FIG. 7. Pressing the button 550 a second time causes the canopy to collapse (by causing the controlled collapse of the rib assembly) while leaving the shaft extended. The user then closes the umbrella by pulling the runner 150 downward.

Figure 14:
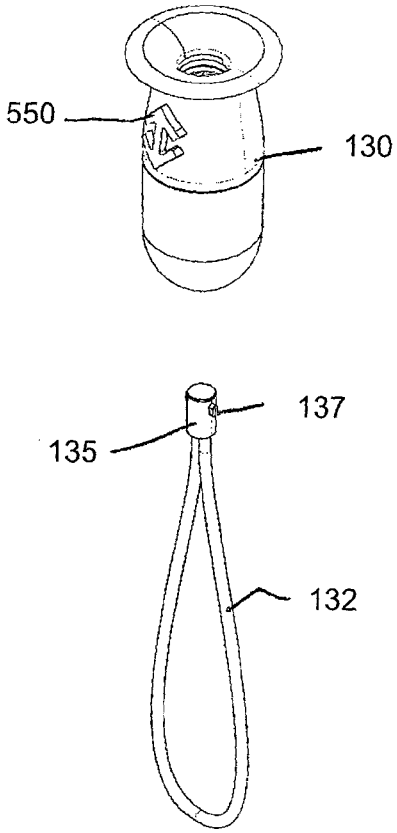
FIG. 14 is an exploded perspective view of an umbrella handle with removable handle strap in accordance with one embodiment of the present invention.
Figure 15:
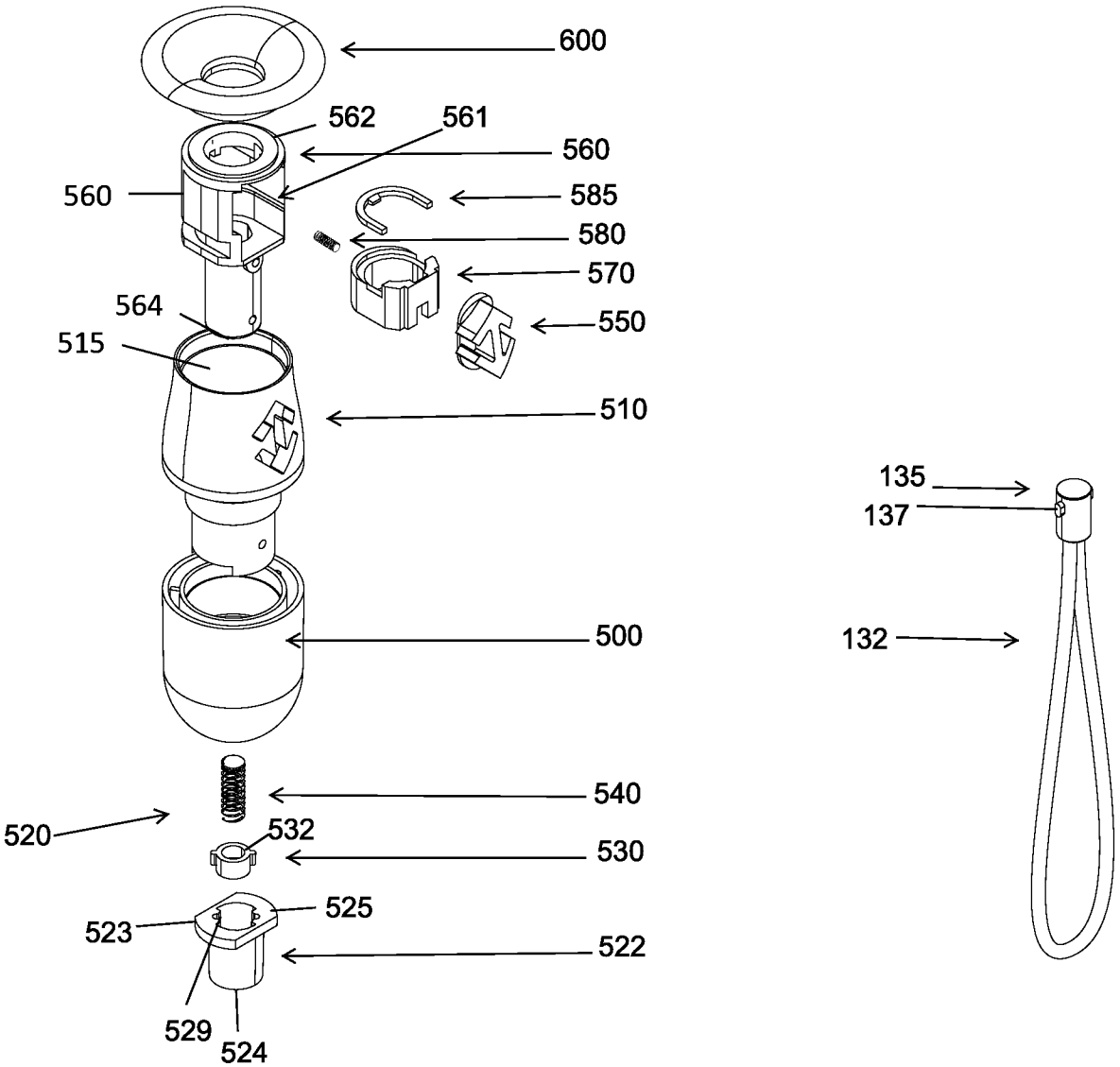
FIG. 15 is another exploded view of the umbrella handle and strap.
Figure 16:
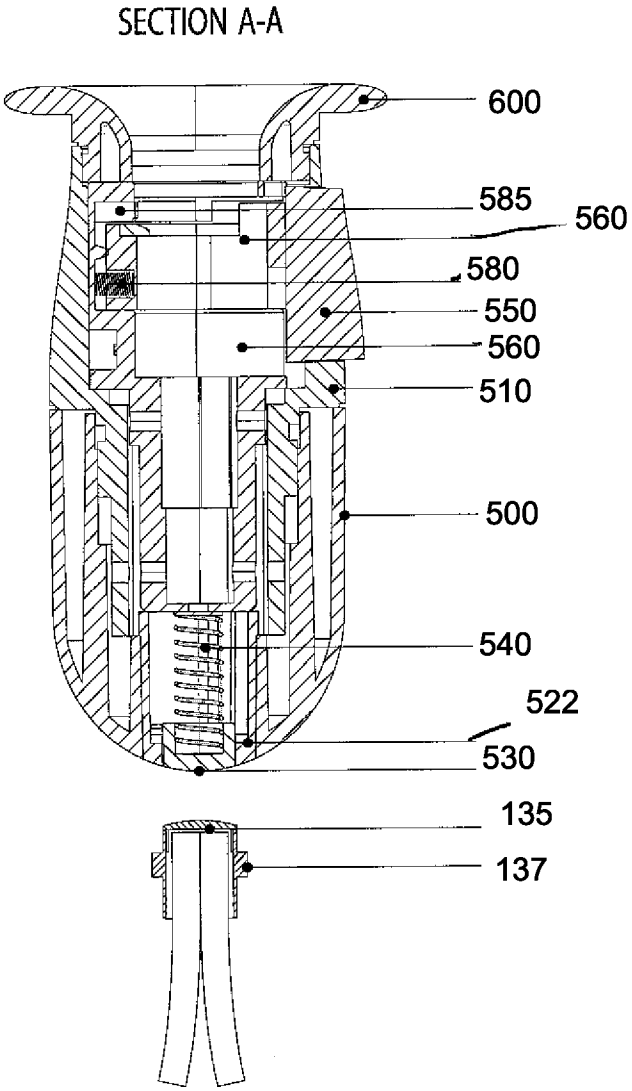
FIG. 16 is a cross-sectional view of the umbrella handle and strap.

FIGS. 14-16 illustrate the details of the handle 130 that is part of the umbrella of FIG. 2. Depending upon the model type of the umbrella, the parts of the handle 130 perform different operations. For example, parts of the handle 130 can be configured to at least partially open the umbrella by advancing the shaft outwardly and at least partially opening the canopy or the handle can, as mentioned previously, be configured to not only open the umbrella but also cause at least partially closing of the umbrella (e.g., collapse of the canopy by collapsing the ribs).

As shown in FIG. 14, the handle 130 includes a looped strap 132 (formed of a suitable material (such as a synthetic) that includes a connector 135. The connector 135 is in the form of a cap (cylindrical shaped housing) with a pair of protrusions 137 extending outwardly from the outer surface of the connector 135. The protrusions 137 can be integrally formed with the cap and are located opposite one another (180 degrees apart). As described herein, the strap 132 is part of a bayonet mount assembly that allows the strap to be easily attached and easily removed from the handle 130 as described herein.

As is known, a bayonet mount is a fastening mechanism consisting of a cylindrical male side with one or more radial pins, and a female receptor with matching L-shaped slot(s) and with spring(s) to keep the two parts locked together. The slots are shaped like a capital letter L with serif (a short upward segment at the end of the horizontal arm); the pin slides into the vertical arm of the L, rotates across the horizontal arm, then is pushed slightly upwards into the short vertical "serif" by the spring; the connector is no longer free to rotate unless pushed down against the spring until the pin is out of the "serif".

As best shown in FIGS. 15 and 16, the umbrella handle 130 is formed of a number of parts, a number of which are conventional. In particular, the handle 130 has a first body part 500 and a second body part 510. The first body part 500 is in the form of handle grip that is located at the lower part of the umbrella handle and the second body part 510 is in the form of a handle body and is located at or near the upper end of the umbrella handle. Each of the first and second body parts 500, 510 is a hollow part and a bottom end of the second body part 510 is received within the hollow interior of the first body part 500 but does not extend all the way to the bottom end of the first body part 500. The first body part 500 also includes an opening in which a bayonet strap assembly 520 is disposed. The bayonet strap assembly 520 includes a female housing 522 that is hollow and includes an opening at a first end 523 and an opening at an opposite second end 524. The first end 523 also includes a flange 525.

The hollow interior and the opening at the second end 524 is configured to be complementary to the shape of the connector 135 and therefore, the interior and the opening at the second end 524 have a circular shape with a pair of notches 529 that extend outwardly from the circular shaped center opening and extend the length of the housing 522. The protrusions 137 of the connector 135 are received within the notches 529. The notches 529 thus provide a guide means for inserting the connector 135 since insertion is not possible unless there is registration between the protrusions 137 and the notches 529.

The strap assembly 520 also includes a bayonet cap 530 and a biasing means, such as a spring, 540 that applies a force to the bayonet cap 530. The cap 530 has a hollow interior that receives one end of the spring 540. The illustrated cap 530 has a cylindrical shape and includes a pair of protrusions 532 that extend outwardly therefrom. The protrusions 532 are similar to the protrusions 137 and are disposed within the notches 529 to allow translation (longitudinal) of the cap 530 within the hollow interior of the housing 522. The other end of the spring 540 is disposed against a wall 535. The spring 540 exerts a biasing force against the cap 530 to cause the cap 530 to be flush with the bottom end of the first body part 500. In other words, the cap 530 remains flush with the exposed bottom surface of the housing 522. This provides an attractive handle design since if the user chooses not to use the looped strap, the bottom of the handle has a clean, attractive appearance since the cap 530 closes off the opening in the housing 522 and remains in this closed position due to the biasing force of the spring 540.

When the user inserts the connector 135 into the bottom opening of the housing 522 with the protrusions 137 aligned with the notches 529, the cap 530 is driven away from the bottom end as the spring 540 compresses. The cap 530 and connector 135 are driven within the hollow interior of the housing 522 until the protrusions 137 of the connector 135 clear the longitudinal notch 529 and upon twisting of the connector 135, the protrusions 137 enter into the locking slots (the "serif"). This action effective locks the connector 135 in place and thus, the looped strap is locked in place with respect to the handle due to the biasing force of the spring 540. To remove the looped strap, the steps are reversed and the connector 135 is rotated until the protrusions 137 line back up with the notches 529. The biasing force of the spring 540 causes the connector 135 to be ejected from the housing 522.

The connector 135 thus represents the male part of the bayonet mount and the housing 522 represents the female part.

In accordance with one aspect of the present invention, the second body part 510 is configured to mate with an actuator assembly in the form of a push button assembly that causes at least one of the deployment (opening) of the canopy and collapse of a fully opened canopy. In particular, the second body part 510 has a through hole or opening 515 formed therein to allow passage of a push button 550 that is accessible to the user and can be pushed to cause activation of the actuator assembly. In one embodiment, the through hole 515 has an arrow shape, such as a double arrow as shown in FIG. 15 or a single arrow. The single arrow button is representative of a system in which pressing the button causes only the extension of the shaft and the user can open the canopy. Conversely, the double arrow button is representative of a system in which pressing the button causes not only the extension of the shaft and the automatic opening of the canopy and pressing the button a second time (when the canopy is open) causes the canopy to automatically close, whereby the shaft is retracted manually to completely close the umbrella.

The actuator (button) assembly further includes a handle interior adapter 560 which has a hollow interior and a first end 562 and an opposite second end 564. The second end 564 is received within the hollow interior of the second body part 510. The handle interior adapter 560 also includes a side opening 561. The assembly further includes a push button actuator 570 which is sized and shaped to be received through the side opening 561 so as to be disposed within the hollow interior of the handle interior adapter 560. The push button actuator 570 slidingly moves (in a lateral direction) within the hollow interior of the handle interior adapter 560. The back of the push button actuator 570 mates with a biasing element 580, such as a spring, that is disposed between the handle interior adapter 560 and the push button actuator 570 to exert a force (restore force) against the push button actuator 570. A push button actuator catch 585 is also provided and disposed within the hollow interior of the handle interior adapter 560.

It will be appreciated that in accordance with the present invention, the push button 550 itself is separate from the push button actuator 570. However, the push button actuator 570 is modular in nature in that the same part can mate with different types of buttons, such as the single arrow button or the double arrow button. The front of the push button actuator 570 can be configured to mate with a rear of the push button 550 in a removable manner. This allows the manufacture to have common actuator parts for a number of models and then simply attach the proper push button and insert into the complementary second body part 510 (handle body) which has a cutout (hole) that mirrors the shape of the button.

The handle assembly is completed with a top ring 600 that mates with a top edge of the second body part 510.

Figure 18:
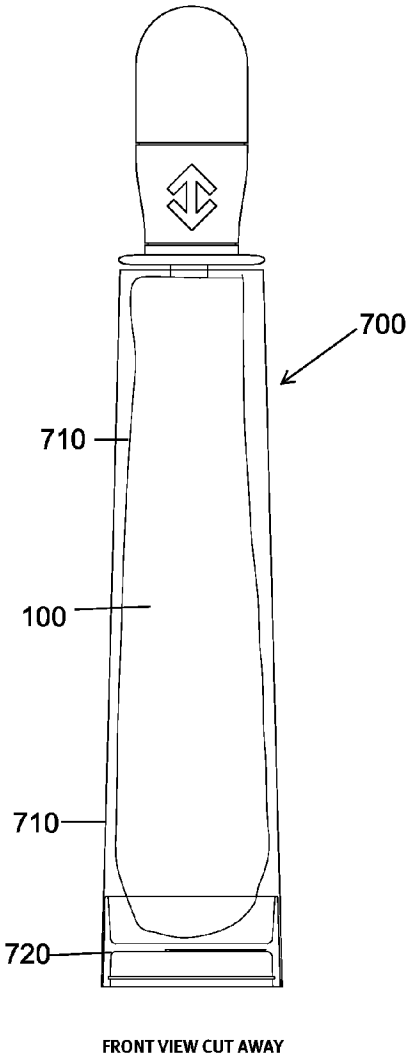
FIG. 18 is a cross-sectional view of the umbrella cover of FIG. 17.
Figure 17:
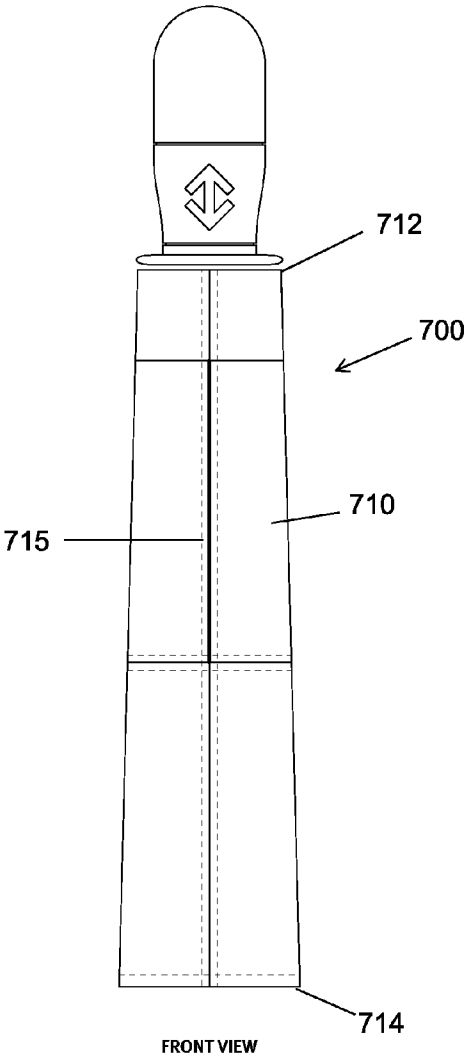
FIG. 17 is a front elevation view of an umbrella cover.

Now referring to FIGS. 17 and 18 in which an exemplary umbrella case 700 is illustrated. The umbrella case 700 is an elongated hollow structure 710 formed of a suitable material, such as a synthetic fabric (e.g., nylon, canvas, etc.). The hollow interior of the structure/body 710 receives the umbrella for storage and a fasteners, such as a zipper or hook and loop straps 715, is provided to close and secure the cover around the umbrella. As is known, traditional umbrella cases are very flexible since they are essentially tubular fabric structures with no rigid parts. This allows the cases to be folded for storage when the umbrella is in use. When the case takes this traditional form, the umbrellas are laid on top of each other for retail display.

The body 710 has an open first end 712 and a closed second end 714. In accordance with the present invention, the case 700 is designed so that it is self-standing and therefore, the umbrella products can be displaced in a vertical (standing up) manner as opposed to lying down. This allows a more prominent display of the product and packaging. To accomplish this, the closed second end 714 of the case 700 has a rigid cup structure 720 (e.g., a base disk with an annular shaped lip or vertical wall around the perimeter). The cup structure 720 is a flat (planar) bottom to allow the case to stand on a flat surface, such as a display. The cup structure 720 can be formed of any number of different materials, including silicon. When inserted into the case, one end of the umbrella is contained within the cup structure 720.

While the invention has been described in connection with certain embodiments thereof, the invention is capable of being practiced in other forms and using other materials and structures. Accordingly, the invention is defined by the recitations in the claims appended hereto and equivalents thereof.

What is claimed is:

1. An umbrella comprising:

an elongated shaft having a first end and an opposite second end;

a runner slidably disposed about the elongated shaft; and a rib assembly including a plurality of sets of ribs that are coupled to the runner by a plurality of struts that move between open and closed positions in which in the open position, the plurality of the sets of ribs are in an open, extended position and in the closed position, the plurality of the sets of ribs are in a closed, collapsed position, each set of ribs including a first rib, a second rib, and a third rib, the first rib being pivotally attached to the elongated shaft and the third rib being a distal rib;

a first rib joint pivotally attaching the first rib to the second rib;

a second rib joint pivotally attaching the second rib to the third rib;

a plurality of anti-inversion spring elements, each anti-inversion spring element being disposed along a length of one second rib, the anti-inversion spring element having a first end that is fixedly attached to the first rib joint and a free opposite second end, the anti-inversion element having a coiled section through which the second rib extends, the anti-inversion spring element being configured to apply to the rib assembly a force that counters an inversion force that is applied to the umbrella; and a flexible wire having a first end attached to the second end of the anti-inversion spring element and a second end attached to a tip that is located at a free distal end of the third rib.

2. The umbrella of claim 1, wherein the anti-inversion spring element is disposed along an underside of the second rib, with the second end thereof being spaced from the underside of the second rib when the sets of ribs are in the open, extended position, the anti-inversion spring element applying a biasing force through use of the wire to resist inversion of the umbrella.

3. The umbrella of claim 1, wherein the first end of the anti-inversion spring element includes a hook that mates with an opening in one end of the first rib joint to securely attach the anti-inversion spring element to the first rib joint, while allowing a length of the anti-inversion spring element that is measured from the coiled section to the second end to be spaced from the second rib.

4. The umbrella of claim 1, wherein the second end of the wire includes a hook member defined by a looped section of the wire that receives a loop at the first end of the wire for releasably attaching the two together.

5. The umbrella of claim 1, wherein the wire comprises a nylon coated stainless steel wire.

6. The umbrella of claim 1, wherein the tip comprises an elongated body having first and second ends and a main opening, extending longitudinally along a length thereof and open at the first end, for receiving the third rib and a connector formed along an outer surface of the elongated body of the tip between the first and second ends, the outer surface of the elongated body having a groove formed therein, wherein the second end of the wire is disposed within the groove and passes through a through hole formed in the connector as it extends to the second end of the anti-inversion spring element.

7. The umbrella of claim 6, wherein the connector comprises a tubular structure with the through hole extending centrally therethrough.

8. The umbrella of claim 1, further including a reinforcing member in the form of an elongated wire structure that has a first end that is attached to the first rib and a second end that is attached to the second rib joint, the reinforcing member having an intermediate coiled section that is disposed about the second rib.

9. The umbrella of claim 1, wherein in the open, extended position, the anti-inversion spring element is disposed substantially below the second rib and the wire is disposed substantially below the third rib.

10. The umbrella of claim 1, further including: (1) a handle at the second end of the elongated shaft, the handle including a first body part having a first opening; and (2) a looped strap having a connector, wherein a bayonet mount is formed between the connector and the first opening of the first body part to allow the looped strap to be releasably attached to the handle.

11. The umbrella of claim 10, wherein the connector includes a pair of opposing protrusions formed along a cap structure and the first body part includes a female housing that defines the first opening that includes a pair of opposing notches that receive the opposing protrusions.

12. The umbrella of claim 11, wherein the first body part includes a handle cover and a spring, the handle cover being received within a hollow interior of the female housing and the spring applying a force against the handle cover such that in a rest position, the handle cover closes off the first opening when the looped strap is removed from the handle.

* * * * *